US009888328B2

(12) United States Patent
Zhong et al.

(10) Patent No.: US 9,888,328 B2
(45) Date of Patent: Feb. 6, 2018

(54) HEARING ASSISTIVE DEVICE

(71) Applicants: Xuan Zhong, Tempe, AZ (US); Shuai Wang, Tempe, AZ (US); Michael F. Dorman, Scottsdale, AZ (US); William Yost, Tempe, AZ (US)

(72) Inventors: Xuan Zhong, Tempe, AZ (US); Shuai Wang, Tempe, AZ (US); Michael F. Dorman, Scottsdale, AZ (US); William Yost, Tempe, AZ (US)

(73) Assignee: Arizona Board of Regents on behalf of Arizona State University, Tempe, AZ (US)

( * ) Notice: Subject to any disclaimer, the term of this patent is extended or adjusted under 35 U.S.C. 154(b) by 40 days.

(21) Appl. No.: 14/558,134

(22) Filed: Dec. 2, 2014

(65) Prior Publication Data

US 2015/0156595 A1 Jun. 4, 2015

Related U.S. Application Data

(60) Provisional application No. 61/910,625, filed on Dec. 2, 2013.

(51) Int. Cl.
*H04R 25/00* (2006.01)
*H04R 3/12* (2006.01)

(52) U.S. Cl.
CPC ..... *H04R 25/606* (2013.01); *H04R 3/12* (2013.01); *H04R 25/405* (2013.01); (Continued)

(58) Field of Classification Search
CPC .. H04R 25/55; H04R 25/554; H04R 2225/59; H04R 25/606
See application file for complete search history.

(56) References Cited

U.S. PATENT DOCUMENTS 8,364,274 B1 * 1/2013 Litvak ..... A61N 1/37264 381/312
8,971,558 B2 * 3/2015 Lunner ..... H04R 25/00 381/312

(Continued)

OTHER PUBLICATIONS

S. Wang et al., "Using Tactile Aids to Provide Low Frequency Information for Cochlear Implant Users", 2013 Conference on Implantable Auditory Prostheses (CIAP 2013), Jul. 14-19 2013, Lake Tahoe, CA, USA.

(Continued)

*Primary Examiner* — Amir Etesam
(74) *Attorney, Agent, or Firm* — Polsinelli PC; Ari M. Bai

(57) ABSTRACT

A hearing assistive device is provided having a microphone, at least one audio signal processing mechanism, a vibration signal processing mechanism, and a vibrator. The audio signal processing mechanism receives an input audio signal from the microphone and generates a first output signal according to the received input audio signal wherein the first output signal coupled to a transducer that generates auditory perception in an ear of a user. The vibration signal processing mechanism receives the input audio signal and generates a second output signal according to the input audio signal. The vibrator is configured to be placed adjacent to the skin of the user, and configured to generate a vibration stimulation signal on the skin of the user according to the second output signal.

17 Claims, 4 Drawing Sheets

(52) U.S. Cl.
CPC ..... *H04R 25/407* (2013.01); *H04R 25/552* (2013.01); *H04R 2225/59* (2013.01)

(56) References Cited

U.S. PATENT DOCUMENTS

| | | | | |
|---|---|---|---|---|
| 9,295,836 | B2 * | 3/2016 | Hillbratt | A61N 1/36032 |
| 2004/0062411 | A1 * | 4/2004 | Retchin | H04R 1/1066 381/376 |
| 2004/0138723 | A1 * | 7/2004 | Malick | H04R 25/552 607/57 |
| 2005/0251225 | A1 * | 11/2005 | Faltys | A61N 1/37229 607/57 |
| 2010/0204755 | A1 * | 8/2010 | Meister | A61N 1/36032 607/57 |
| 2011/0098112 | A1 * | 4/2011 | LeBoeuf | A61B 5/0205 463/31 |
| 2012/0004706 | A1 * | 1/2012 | Meister | A61N 1/36032 607/57 |
| 2012/0177233 | A1 * | 7/2012 | Kidmose | A61B 5/04845 381/314 |
| 2012/0237075 | A1 * | 9/2012 | East | H04R 1/1066 381/381 |
| 2013/0044889 | A1 * | 2/2013 | Jensen | H04R 25/356 381/60 |
| 2014/0179985 | A1 * | 6/2014 | Andersson | H04R 25/606 600/25 |
| 2014/0205122 | A1 * | 7/2014 | Stoffels | H04R 25/608 381/328 |
| 2015/0110322 | A1 * | 4/2015 | Andersson | H04R 25/552 381/326 |
| 2015/0208183 | A1 * | 7/2015 | Bern | H04R 25/65 381/326 |
| 2015/0289065 | A1 * | 10/2015 | Jensen | H04R 25/552 381/315 |
| 2016/0066104 | A1 * | 3/2016 | Minnaar | H04R 25/554 381/23.1 |

OTHER PUBLICATIONS

S. Wang et al., "Using tactile aids to provide low frequency information for cochlear implant users", J. Acoust. Soc. Am. 134, 4235 (2013).

X. Zhong et al., "Sound source localization from tactile aids for unilateral cochlear implant users", J. Acoust. Soc. Am. 134, 4062 (2013).

G.A. Gescheider, "Role of Phase-Difference Cues in the Cutaneous Analog of Auditory Sound Localization", J. Acoust. Soc. Am., vol. 43, No. 6, pp. 1249-1254 (1968).

J.A. Weisenberger, "Evaluations of single-channel and multichannel tactile aids for the hearing impaired", J. Acoust. Soc. Am. Suppl. 1,vol. 82, p. S22 (1987).

C.A. Brown et al., "Fundamental frequency and speech intelligibility in background noise", Hearing Research, 266(1-2), 52-59, (2010).

M.F. Dorman, et al., Combining acoustic and electric stimulation in the service of speech recognition. International journal of audiology, 49(12), 912-9 (2010).

B.S. Wilson, "Cochlear implants: Current designs and future possibilities", The Journal of Rehabilitation Research and Development, 45(5), 695-730 (2008).

H.Z. Tan et al., "Temporal masking of multidimensional tactual stimuli", Journal of Acoustical Society of America, 114 (6), 3295-3308 (2003).

S. Spitzer et al., "The use of fundamental frequency for lexical segmentation in listeners with cochlear implants", Journal of the Acoustical Society of America, 125(6), EL236-EL241 (2009).

J.M. Liss, et al., "Syllabic strength and lexical boundary decisions in the perception of hypokinetic dysarthric speech", Journal of the Acoustical Society of America, 104, 2457 (1998).

G.A. Gescheider, "Cutaneous Sound Localization", J. Exp. Psych. 70(6), pp. 617-635 (1965).

* cited by examiner

HEARING ASSISTIVE DEVICE

CROSS REFERENCE TO RELATED APPLICATIONS

This application claims benefit to U.S. provisional patent application Ser. No. 61/910,625 filed on Dec. 2, 2013, which is herein incorporated by reference in its entirety.

FIELD

Aspects of the present disclosure relate to prosthetic devices, and in particular, to a hearing assistive device.

BACKGROUND

Cochlear implants (CIs) are a type of neural prosthesis that is adapted to restore human auditory functions for people with hearing losses that are too severe to be compensated by hearing aids. It is estimated that around the globe over 200,000 people with severe to profound hearing loss have been implanted with CIs. Typically, more than half of those users are unilaterally implanted, that is, only one CI on a single side of the user's head. In many cases, certain users of CIs may lack the spatial awareness compared to normal hearing users

SUMMARY

According to aspects of the present disclosure, a hearing assistive device is provided having a microphone, at least one audio signal processing mechanism, a vibration signal processing mechanism, and a vibrator. The audio signal processing mechanism receives an input audio signal from the microphone and generates a first output signal according to the received input audio signal wherein the first output signal coupled to a transducer that generates auditory perception in an ear of a user. The vibration signal processing mechanism receives the input audio signal and generates a second output signal according to the input audio signal. The vibrator is configured to be placed adjacent to the skin of the user, and configured to generate a vibration stimulation signal on the skin of the user according to the second output signal.

BRIEF DESCRIPTION OF THE DRAWINGS

Corresponding reference characters indicate corresponding elements among the view of the drawings. The headings used in the figures do not limit the scope of the claims.

DETAILED DESCRIPTION

It should be understood from the foregoing that, while particular embodiments have been illustrated and described, various modifications can be made thereto without departing from the spirit and scope of the invention as will be apparent to those skilled in the art. Such changes and modifications are within the scope and teachings of this invention as defined in the claims appended hereto.

Although the performance of cochlear implants has been successful in providing auditory reception for severe hearing impaired users, currently available cochlear implants may not provide adequate low-frequency information to users for various reasons that may include limited insertion depth of their associated electrodes, and clustering of spiral ganglion in the cochlea of the users. Nevertheless, low-frequency acoustic information from an extra hearing aid on the ear contralateral to a cochlear implant can provide, in some cases, up to a 40 percent (%) increase in speech understanding scores. However, roughly only half of all cochlear implant users have residual hearing in the ear contralateral to the implanted ear, while an even smaller number have hearing in the implanted ear. As a result, a demand exists for alternative methods of adding low-frequency information to cochlear implant users.

Figure 1A:
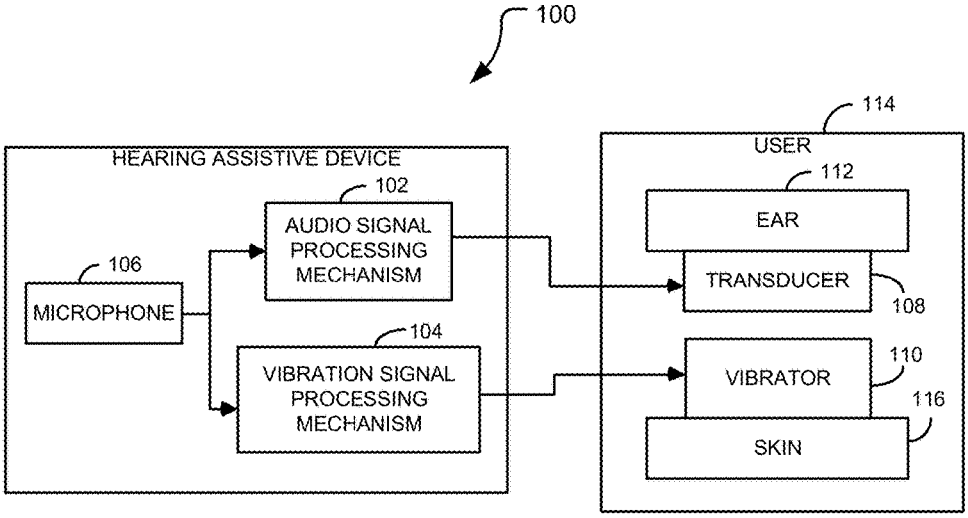
FIGS. 1A and 1B illustrate example hearing assistive devices according to embodiments of the present disclosure.

FIG. 1A illustrates an example hearing assistive device 100 according to one embodiment of the present disclosure. The hearing assistive device 100 includes an audio signal processing mechanism 102 and a vibration signal processing mechanism 104 that each receives an input audio signal from a microphone 106 to generate output signals for energizing a transducer 108 and a vibrator 110, respectively. The transducer 108 is placed adjacent to an ear 112 of a user 114, while the vibrator 110 is placed adjacent to the skin 116 of the user 112 for enhancing the hearing capability of a user.

Figure 1B:
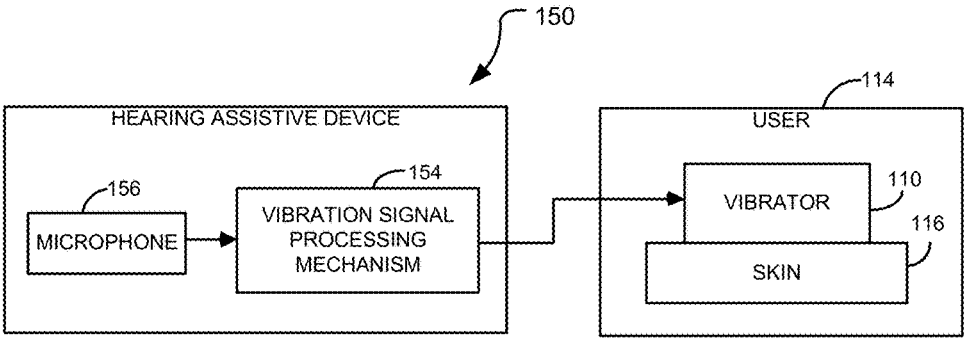

FIG. 1B illustrates another example hearing assistive device 150 according to one embodiment of the present disclosure. The hearing assistive device 150 includes a vibration signal processing mechanism 154 that receives an input audio signal from a microphone 156 to generate a vibration signal for energizing a vibrator 110 that are similar in design and construction to corresponding components of the hearing assistive device 100 of FIG. 1A. However, the hearing assistive 150 differs from the hearing assistive device 100 of FIG. 1A in that no similar audio signal processing mechanism or transducer is provided. For example, this particular embodiment may be provided as a complementary device to another hearing assistive device, such as a cochlear implant for enhanced hearing capability. That is, the hearing assistive device 150 may be implemented on a user in conjunction with another device, such as a cochlear implant that includes the audio signal processing mechanism 102, and transducer 108, such that the hearing assistive device 100 and cochlear implant function in combination to assist the hearing capabilities of a user.

In one embodiment, the combination of the microphone 106, audio signal processing mechanism 102, and transducer 108 comprises a cochlear implant in which the transducer 108 includes one or more electrodes that are implanted proximate the cochlea of the user. In this case, the vibration signal processing mechanism 104 is implemented to augment the hearing capability of a cochlear implant user via the vibration signal processing mechanism 104 and vibrator 110 that uses vibration to simulate low frequency audio signals. Nevertheless, it should be understood that the teachings of the present disclosure may be applied to other types of sound assistive devices, such as those sound assistive device used on single sided deafness users aided on one side by a hearing aid.

In general, the vibrator 110 simulates low frequency sound sensations that may enhance the hearing capability of hearing impaired users, such as cochlear implant users. The vibration signal processing mechanism 104 receives and/or amplifies an audio signal from the microphone 106 of a cochlear implant device or a stand-alone device. The vibration signal processing mechanism 104 may then band-pass filter the signal at suitable lower and upper levels (e.g., a lower cut-off frequency of 50 Hz and an upper cut-off frequency of 500 Hz). Multiple sound envelopes may be extracted and may be conveyed to multiple vibrators, wherein the vibrators are configured to provide a vibration sensation on the skin 116 of the user 112.

The band-pass filters may be at least one of a digital filter or an analog filter. Extracting the band-passed signals may depend on the frequency band of the band-pass filter. The band-passed signals may further be separated into an envelope portion and a temporal fine structure portion. The separation may be performed using any suitable technique. In one embodiment, the separation is provided by a Hilbert transformation. In another embodiment, the separation may be provided by a combination of a rectifier and a low-pass filter, which may either be implemented as analog circuitry or digital circuitry, or a combination of analog and digital circuitry.

Conveying the band-passed signals and envelope signals to the vibrator 110 may further comprise obtaining the envelope signals, generating a carrier signal, modulating the carrier signal, wherein the amplitude of the carrier signal may depend on the envelope signals, amplifying the amplitude-modulated carrier signal, and conveying the amplified-modulated carrier signal to the vibrators. The carrier signal may be generated using at least one of a digital or analog signal generator, wherein the carrier signal may be at least one of a pure tone signal with a frequency between 100 and 500 Hertz (Hz) or a noise signal with various spectral components.

Tactile sensation, which has a frequency response in the range of 0 to 500 Hz, is somewhat similar to low frequency hearing, making it a good candidate for alternative low-frequency signal sources. This frequency range is comparatively broad and happens to complement the frequency range of cochlear implants, which only begins to work above approximately 200 Hz due to spiral ganglion clustering. The frequency range of tactile response can be categorized into three distinct regions based on subjective description or feeling: (1) slow motion in the 0-6 Hz range; (2) fluttering motion in the 10-70 Hz range; and (3) smooth vibration in the 150 Hz and beyond range.

Tactile sensation is not ordinarily as responsive as auditory sensation. For example, typical onset detection in tactile sensation may be approximately 100 milliseconds (ms) on the same location on the skin and approximately 50 ms between different locations on the skin. It has also been observed that utilization of the vibro-tactile voicing cue requires a user to discriminate the temporal onset order of tactual stimuli with asynchronies in the range of 50-200 ms. Tactile sensation offers a comparatively large dynamic range from 40 to 50 decibels (dB). Above 50 dB, measurement of tactile sensation becomes impractical due to large movement of stimulator, which often causes the skin of the user to not remain in contact with the vibrator. Within this dynamic range, a 2-3 dB change in vibration level can be detected.

Figure 2:
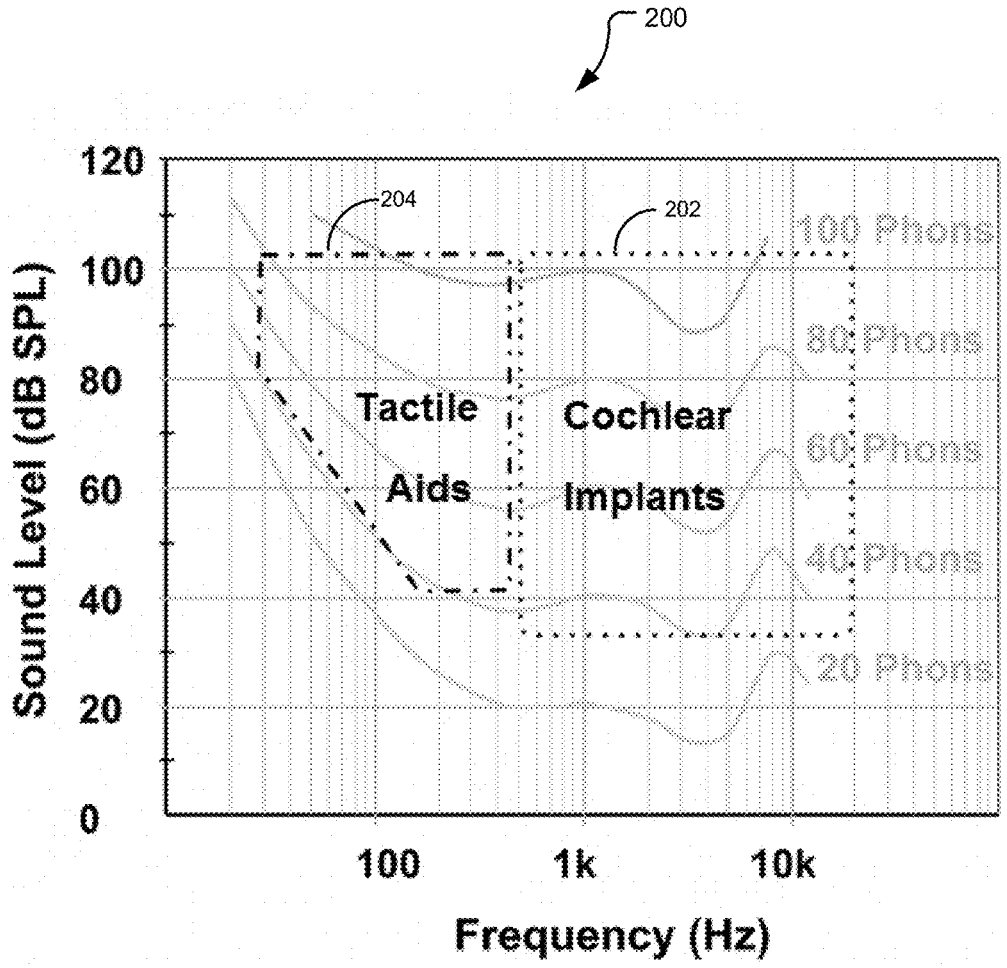
FIG. 2 illustrates an example graph showing average auditory sensory response levels for humans.

FIG. 2 illustrates an example graph 200 showing average auditory sensory response frequency and level ranges for humans. The graph 200 includes a first region 202 indicating a first range of frequencies in which hearing impaired humans may be responsive to CIs, while a second audio response region 204 indicates a second range of frequencies and levels in which humans may be responsive to tactile vibration. The senses of touch and low-frequency hearing may share some commonality, which may be exploited to simulate low frequency sound using vibration. As discussed before, the sense of touch has a dynamic range of 40~50 dB with a resolution of 2~3 dB. The sense of touch is also known to be responsive to vibro-tactile inputs from the very low frequencies up to around 400~500 Hz. The current cochlear implants, on the other hand, provide a decent dynamic range and discrimination only at mid- to high-frequency range. Due to the clustering of spiral ganglion (the part that is being stimulated by the CI) at the apical part of the cochlea and the difficulty to put electrodes into the most apical part of the cochlea, the CI may not accurately provide adequate frequency discrimination below approximately 420 Hz. When the dynamic and frequency ranges of the vibro-tactile sense and the CI are put together as shown in FIG. 2, it could be observed that the two sources of information are complementary in frequency and level range, which provides the hope that the two devices might work together to generate more complete set of cues of speech compared to cases in which the CI is used individually.

Figure 3:
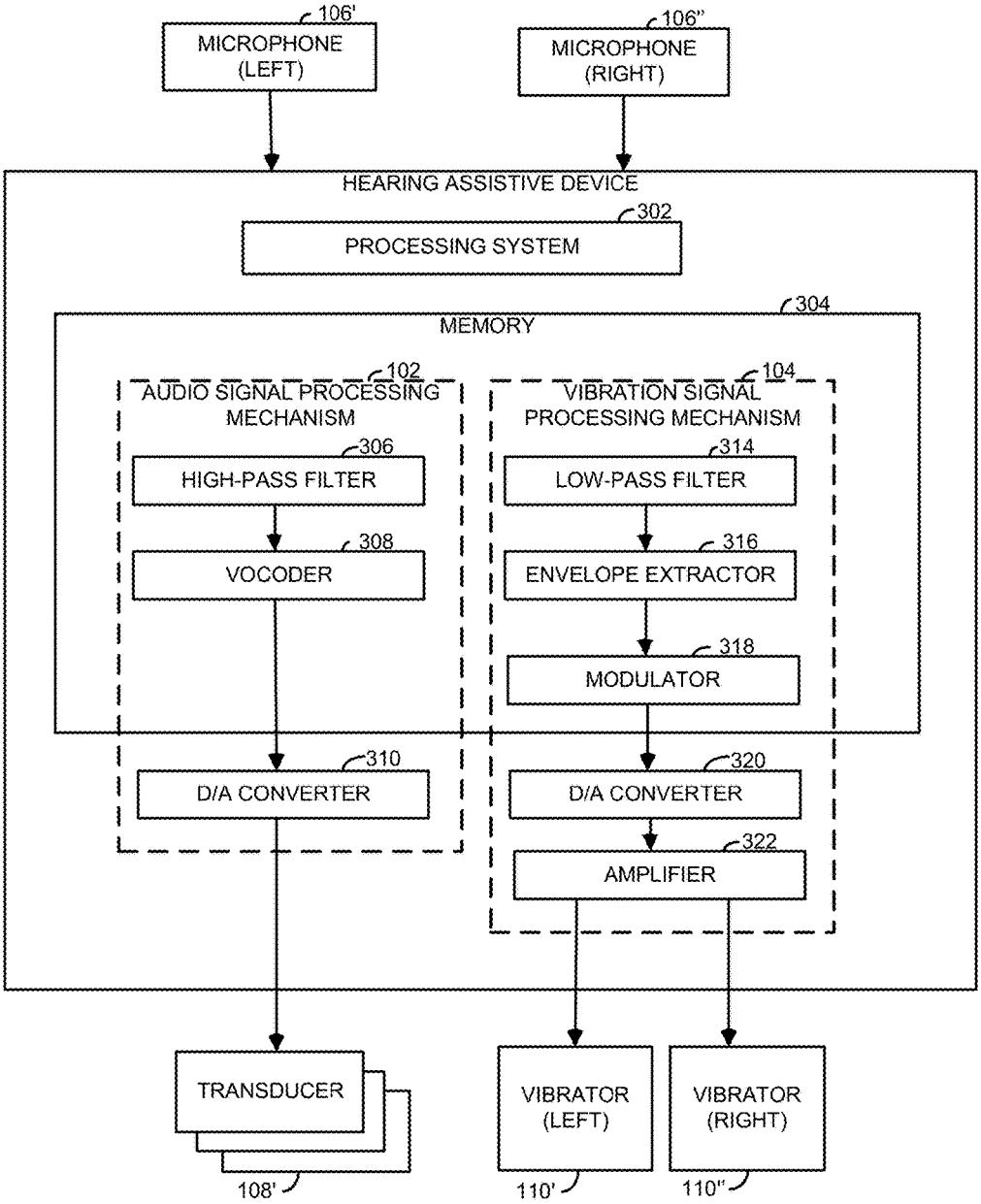
FIG. 3 illustrates an example implementation of the hearing assistive device according to one embodiment of the present disclosure.

FIG. 3 illustrates an example implementation of the hearing assistive device 100 according to one embodiment of the present disclosure. The hearing assistive device 100 includes a processing system 302 that executes the audio signal processing mechanism 102 and a vibration signal processing mechanism 104 stored in a memory 304. Although the audio signal processing mechanism 102 and vibration signal processing mechanism 104 are shown implemented as computer-readable instructions that may be executed on the processing system 302, it should be understood that the various elements of the audio signal processing mechanism 102 and vibration signal processing mechanism 104 described herein may be implemented as discrete hardware components, such as operational amplifiers, transistors, or other suitable signal processing mechanisms.

The memory 304 includes volatile media, nonvolatile media, removable media, non-removable media, and/or another available medium. By way of example and not limitation, non-transitory memory 304 comprises computer storage media, such as non-transient storage memory, volatile media, nonvolatile media, removable media, and/or non-removable media implemented in a method or technology for storage of information, such as computer readable instructions, data structures, program modules, or other data.

The audio signal processing mechanism 102 includes a high-pass filter 306, a vocoder 308, and a digital to analog (D/A) converter 310. As shown, the high-pass filter 306 and the vocoder 308 are implemented as instructions to be executed by the processing system 302, while the D/A converter 310 is implemented as a discrete hardware component. Nevertheless, it should be appreciated that either of the high-pass filter 306, vocoder 308, and/or digital to analog (D/A) converter 310 may be implemented as instructions or discrete components.

The high-pass filter 306 receives input audio signals from one or more microphones 106' and 106", which in this particular example are two microphones. Nevertheless, it should be appreciated that any quantity of microphones may be implemented, such as three or more microphones. The vocoder 308 receives the filtered signal from the high-pass filter 306 and encodes the signal, which is then fed to the D/A converter 310. The D/A converter 310 converts the digital signal to an analog signal, which is then fed to a transducer array 108' having one or more independently functioning transducers for exciting the inner ear of the user.

In one embodiment, the audio signal processing mechanism 102 comprises a cochlear implant and the transducer array 108' comprises a group of electrodes that are configured to electrically excite the auditory nerve of the user.

The vibration signal processing mechanism 104 includes a low-pass filter 314, an envelope extractor 316, a modulator 318, a D/A converter 320, and an amplifier 322. As shown, the low-pass filter 314, envelope extractor 316, and modulator 318 are implemented as instructions to be executed by the processing system 302, while the D/A converter 320 and amplifier 322 are implemented as discrete hardware components. Nevertheless, it should be appreciated that either of the low-pass filter 314, envelope extractor 316, modulator 318, D/A converter 320, and/or amplifier 322 may be implemented as instructions or discrete components without departing from the spirit or scope of the present disclosure.

Like the audio signal processing mechanism 102, the low-pass filter 314 receives input audio signals from the microphones 106' and 106". The original sound signal acquired from the microphones may be subjected to a band-pass filter 314. The band-pass filter 314 may be implemented to reduce or alleviate aliasing as well as making the useful spectral signals more salient. The choice of frequencies for the band-pass filter depends on which portion of the spectral signal the designer thinks is more important for speech processing. In one embodiment, the input signal from the microphones 106' and 106" are filtered with a lower cut-off frequency of 50 Hz and a higher cut-off frequency of 500 Hz. The lower frequency cut-off should cover the lowest sound frequencies of speech, while the higher cut-off can be as low as 500 Hz to only separate the speech fundamental frequency to about 10 kHz, where human speech has little remaining energy.

In one embodiment, the band-pass filter may be a second order filter, which is relatively common and easy to implement. In other embodiments, other filter types may be used. For example, a digital filter may be implemented using either a proprietary digital signal processing core or a general purpose embedded system. For another example, an analog filter may be used that may be either a stand-alone operational amplifier with discrete components (e.g., transistors, operational amplifiers, capacitors, resistors, etc.) or an application specific integrated circuit (ASIC). Certain implementations of an analog filter may have an advantage of being lower cost, lower latency, and lower power consumption then its processor-based counterpart.

The envelope extractor 316 extracts multiple envelopes from the received band-passed signal from the band-pass filter 314. In some respects, the envelopes may be extracted under the theory that humans may be able to detect speech using only the envelope (e.g., general shape) of the band-passed signal. Thus, the envelope extractor 316 extracts the overall envelope information in the sound signal, which may contain useful information that may be reconstructed by the human brain. The envelope extractor 316 may provide frequencies that, in some cases, are not easily reproduced by the audio signal processing mechanism 102 (i.e., low frequencies). That is, the envelope extractor 316 may provide envelopes of frequencies that interlay with the audio signal processing mechanism 102 so that the user has two sources from which to sense the audio signal from the microphones 106' and 106". In one embodiment, a Hilbert transformation may be used to separate the envelope portion from the fine structure portion. Alternatively, the signal is first rectified and then filtered using a low-pass filter to obtain a smooth envelope curve of the sound.

The modulator 318 modulates the signals received from the envelope extractor 316 to generate pure tone signals suitable for reproduction by one or more vibrators 110' and 110". For example, a carrier signal having a suitable frequency (e.g., 100 to 500 Hz) may be amplitude modulated by the envelopes received from the envelope extractor 316. The carrier signal may be generated using at least one of a digital or analog signal generator in which the carrier signal is a pure tone signal or a noise signal with various spectral components.

The D/A converter 320 converts digital signals from the modulator 318 to analog signals that may be amplified by the amplifier 322 to be conveyed to the skin 116 of the user 112 using one or more vibrators 110' and 110". The vibrators 110' and 110" generate a vibration on the human skin 116. In one embodiment, the vibrators 110' and 110" may be placed on the pinnae of the ears of the user, such as behind the ear and facing the pinna of the user. In another embodiment, the vibrators 110' and 110" may be placed adjacent to the mastoid portion of the temporal bone structures of the human skull. In other embodiments, the vibrator may be placed on any suitable part of the user's body. The vibrators 110' and 110" may be any suitable type, such as a moving coil transducer or a piezoelectric transducer. While moving coil transducers may be lower in cost, piezoelectric transducers are smaller and may be more energy efficient, thus enabling relatively longer operation under battery power.

In another embodiment, the system may provide improved sound localization to a hearing assistive device, such as a cochlear implant that has an audio signal processing mechanism 102 that uses electrical excitation of the cochlea of the user. The vibration signal processing mechanism 104, along with the vibrators 110' and 110" themselves do not have inherent directivity related to the location of a sound source. For this reason, either directional microphone components, or a beamforming sound pre-processor based on the incoming acoustic signal of two or more omnidirectional microphones may be used on each side. A typical beamforming microphone array comprises of two or more omnidirectional microphones. The direction of arrival can be calculated based on the time of arrival of signals at two or more microphones. A pre-processor would apply a so called spatial filtering technique to apply stronger attenuation to signals at unwanted directions.

In another embodiment, one or more directional microphones can be used instead of a preprocessor with omnidirectional microphones. Directional microphones commonly have two ports of sound inlets. Physically the different directions of sound signal would cause a different phase of the signal at the two ports and would result in the phase difference on the two sides of the membrane of the microphone unit. Thus the voltage output of the microphone directly relates to the direction of the sound source. The directivity pattern of this kind of microphone units can be cardioid or any other suitable shape. In one embodiment, the basic cardioid shape can be used since the angular direction and response generally has a one-to-one relation in contrast to a super cardioid which a signal response can correspond to two directions.

In some cases, localization of sound sources (e.g., direction from the user that the sound source originates) may, in some cases, be relatively difficult for unilateral sound assistive device users, especially the unilateral cochlear implant users who only have access to monaural acoustic signal input. When normal hearing listeners localize sound sources, they often rely on the interaural cues which are not available for unilateral sound assistive devices. Sound source localization performance around the chance level could often be expected from some or most of the unilateral CI users, despite several outliers who may have relied on the monaural spectral cues.

Another problem that unilateral sound assistive device users may have is the intelligibility of speech in the presence of noise. In certain environments, the cues that sound assistive device users rely on for speech recognition can be degraded or masked by surrounding sounds or competing talkers, the level of degradation depending on the form and level of noise. Although speech recognition of people with normal hearing may also decrease somewhat in the presence of noise, the same problem affects hearing impaired users even more acutely compared to normal hearing listeners with a higher degree of variation. Potentially, the missing cues such as the lack of temporal fine structure and intensity information may limit the amount of information available to the sound assistive device users.

A conventional solution to the problems of spatial localization and of speech recognition in noise has been binaural implantation (i.e., sound assistive devices on both ears of the users). By adding another source of information, the level difference could be compared between the two channels. As a result, sound source localization performance with bilateral implantation may provide improved hearing over that provided by unilateral sound assistive device users. In terms of speech recognition, since the bilateral users have an extra channel of audio input and there is mostly one ear on the side of the source, the combined effect can provide a benefit in speech intelligibility using an additional sound assistive device. Nevertheless, two sound assistive devices effectively doubles the cost of sound assistive device, which can be cost prohibitive in some cases.

The primary spatial hearing cues for human listeners with normal hearing are interaural time difference (ITD), interaural level difference (ILD) and head-related transfer function (HRTF). Due to the size and shape of the head, the acoustic signal from a sound source on one side of the user's head arrives at the two ears at different times. This temporal difference is called ITD, which is the primary cue being used for the low frequency sound source localization. In another aspect, due to the shadowing effect of the head and the torso, the acoustic signal is extenuated to different degrees at the two ears when the sound source is on one side. The level difference caused by the direction-dependent extenuation is called ILD, which is responsible for the mid- to high-frequency localization. For even higher frequencies, the diffraction from the head creates direction-dependent peaks and valleys on the spectral response, i.e., HRTF.

The perceived level rating scale of vibration on the skin is generally proportional to the amplitude of the vibration, with a dynamic range of 40~50 dB and a discriminable step of 2~3 dB, which suggests the possibility of using tactile ILD as the major spatial hearing cue through sensory substitution. On the other hand, the maximal ITD of the normal human listeners is around 0.7 ms, while the minimal temporal difference that the skin is able to discriminate is larger than that. Thus, using ITD for tactile localization of sound sources may not be a good solution. The vibro-tactile sensation is also known to be irresponsive to stimuli that are higher than 400~500 Hz. As a result, using the high frequency HRTF for sound source localization may also be difficult to accomplish.

In another embodiment, one or more directional microphones can be used instead of a preprocessor with omnidirectional microphones. Directional microphones commonly have two ports of sound inlets. Physically the different directions of sound signal would cause a different phase of the signal at the two ports and would result in the phase difference on the two sides of the membrane of the microphone unit. Thus the voltage output of the microphone directly relates to the direction of the sound source. The directivity pattern of this kind of microphone units can be cardioid or any other suitable shape. In one embodiment, the basic cardioid shape can be used since the angular direction and response generally has a one-to-one relation in contrast to a super cardioid which a signal response can correspond to two directions.

Directional microphones are acoustic sensors that are more responsive to sounds that come from certain directions. The directivity pattern of directional microphones may be delimited according to one of several categories, such as a figure 8-shaped sensitivity pattern, a cardioid-shaped sensitivity pattern, and the like. A popular approach to achieve the directivity is to use a single unit that is designed to be sensitive to the gradient of the sound pressure instead of the sound pressure itself. In such a design, the back cavity of the microphone is acoustically open. The sound from certain directions has to travel a further distance in order to reach the back of the membrane, the distance depending on the direction of arrival (DOA) of the acoustic signal. Another design option is to use two omnidirectional microphones, and performing a subtraction of the responses of the two microphone units such that the resulting signal would be more responsive to certain DOA. Mathematically, these two solutions are the same. Practically the first, single unit design is easier to implement whereas the second design is more versatile but takes an extra microphone unit and related circuitry.

Compared to the natural directivity pattern caused by the human head and the outer ear, directional microphones have directivity patterns that are comparatively more consistent across multiple frequencies. The outer ear is known as a filter that alters the mid-high frequency signals in a direction-dependent manner, but the directionality is different across the frequencies. The difference between the human ear and the directional microphone originates from the different physical principles underlying the pressure sensors and/or pressure-gradient sensors. A more uniform directivity pattern of directional microphones across multiple frequencies may be a favorable characteristic that could, in some cases, provide users with more reliable spatial hearing cues.

Figure 4A:
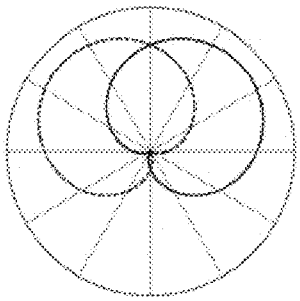
FIGS. 4A-4C illustrate example reception patterns of a X-Y coincidence pair of microphones, a channel level difference of the microphones, and a combined response pattern of the two microphones that may be used with the hearing assistive device according to one embodiment of the present disclosure.
Figure 4B:
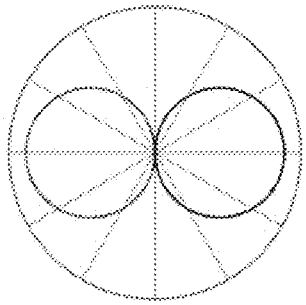
Figure 4C:
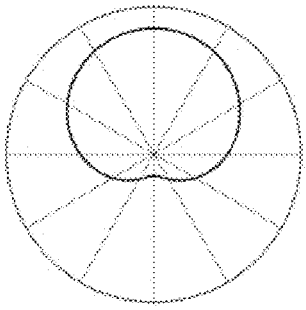

FIGS. 4A-4C illustrate example reception patterns of a X-Y coincidence pair of microphones, a channel level difference of the microphones, and a combined response pattern of the two microphones that may be used with the hearing assistive device according to one embodiment of the present disclosure. The two directional microphones used in the experimental tactile aids were arranged in the form of the X-Y coincidence pair as shown in FIG. 4A, which was designed to provide the users with spatial-angle-dependent level differences with a relatively good degree of discrimination. In the field of electro-acoustics, the X-Y pair may create relatively good sound images. In the X-Y pair, the two cardioid-shaped directional microphones were put close to each other (e.g., 8 centimeters apart). The most responsive direction, or axis, of the right microphone unit pointed 45 degree to the right on the horizontal plane, the other 45 degree to the left on the horizontal plane, thus forming a 90 degree angle between the two.

The adequacy and redundancy of the set of cues would be discussed in the context of sound source localization on the horizontal plane. For simplicity, it is assumed that the maximal response, A0 is equal for all microphones, and that the microphone on the CI device is omnidirectional. That is, if the front direction of the listener corresponds to 0 degree and the angle θ increase in a counter-clockwise manner on the horizontal plane, the directional response of the two microphones involved in the X-Y pair as shown in FIG. 4A can be written as:

$$\begin{cases} R_{TA-L} = A_0 \dfrac{1+\cos\left(\theta - \frac{\pi}{4}\right)}{2} & \text{(1a)} \\ R_{CI} = A_0 & \text{(1b)} \\ R_{TA-R} = A_0 \dfrac{1+\cos\left(\theta + \frac{\pi}{4}\right)}{2} & \text{(1c)} \end{cases}$$

Here, $R_{TA\ L}$ is the response of the left tactile aid, $R_{TA\ R}$ is the response of the right tactile aid, $R_{CI}$ is the response of the cochlear implant. The inter-channel level difference (ILD, denoted ΔR) between the left and right tactile aids is:

$$\Delta R = R_{TA-L} - R_{TA-R} = \frac{\sqrt{2}}{2} A_0 \sin\theta \tag{2}$$

or, $$\theta = \sin^{-1}\left(\frac{\sqrt{2}\,\Delta R}{A_0}\right) \tag{3}$$

So the left-right angular position θ of the sound source is uniquely decided by tactile aids inter channel level difference AR as shown in FIG. 4B. For front-back discrimination, multiple strategies can be used. As an example, $R_{TA-L}$ and $R_{TA-R}$ can be combined and then compared with $R_{CI}$.

$$R_{SUM} = A_0 \frac{1+\cos\left(\theta - \frac{\pi}{4}\right)}{2} + A_0 \frac{1+\cos\left(\theta + \frac{\pi}{4}\right)}{2} = R_{CI}\left(1 + \frac{\sqrt{2}}{2}\cos\theta\right) \tag{4}$$

or $$\theta = \cos^{-1}\left[\sqrt{2}\left(\frac{R_{SUM}}{R_{CI}} - 1\right)\right] \tag{5}$$

Here $R_{SUM}$ denotes the combined response as shown in FIG. 2c, which is increasingly bigger towards the front side. $A_0$ is replaced with $R_{CI}$ according to eq. 1b. The results mean that the front-back angular position θ can be uniquely decided by combined level and CI response difference ΔR and CI response $R_{CI}$.

If the calculated left-right angular position from equation (3) is combined with front-back angular position from equation (5), the exact angular location on the 360 degree horizontal plane can be decided, while having redundancy of information. That is to say, when equation (3) gives the left-right angular positions of a sound source, equation (5) may only serve to disambiguate the front-back confusion.

Any type of vibrator may be used that passes the processed vibration signals to the skin of the user in an effective, efficient and reliable manner. The commercial options specially designed for the application of tactile aids was very limited. In one embodiment, the vibrators comprises linear resonant actuators (e.g., moving coil resonators) having a body length of 3.6 mm and a diameter of 10 mm. The body of the vibrator was enclosed in a metal capsule having no external moving parts.

In another embodiment, the vibrators comprise a wide-band moving coil resonator. In yet another embodiment, the vibrators comprise piezoelectric transducers, which were more efficient in terms of power consumption and may also provide some extra bandwidth. But the piezoelectric transducers were also known to be fragile and risky because high voltage may be exposed to the human skin. Mechanically they were also more difficult to mount on an actual commercial device due to the need for extra space behind the vibrating bar or plate.

A favorable mounting position of the current design would be behind the ear. In terms of form factor, a finished tactile aid product could be similar to a regular behind-the-ear (BTE) hearing aid. The tactile sensitivity and dynamic range of different parts of the body are not the same. In general, thicker and softer skin may often correspond to bigger dynamic range, and some tactile stimulators placed the vibrators around the abdomen or near the breast of the user. Apart from that, the human pinnae are also found to be among the most sensitive places with a decent dynamic range. When the BTE tactile device is put on the ear, the side of the device enclosure facing the back of pinna could be used to mount the vibration generating device.

Any quantity of microphones, transducers, and vibration generating devices may be implemented. In a particular embodiment, the hearing assistive device 100 includes a single audio transducer 108, a pair of microphones, and a pair of vibration generating devices. Such a configuration may be able to, in at least some cases, be able to partially restore the sound source localization ability and improve the speech recognition ability in the presence of noise. To generate useful cues for the tactile sensation to localize the sound sources, two directional microphones in the form of an X-Y pair (e.g., FIG. 4A) are used. In general, when used in conjunction with a single transducer implemented as a CI, the inter-channel cues could provide enough information to reveal the sound source locations. The vibrations on the skin of the user may provide segmentation and stress patterns, which are helpful cues for speech intelligibility especially in noise. Additionally, embodiments of the present disclosure may provide benefits over conventional sound localization techniques (e.g., bilateral implantation or bimodal implantation, etc.), which are either costly or require a certain level of residual hearing.

It is believed that the present disclosure and many of its attendant advantages will be understood by the foregoing description, and it will be apparent that various changes may be made in the form, construction, and arrangement of the components without departing from the disclosed subject matter or without sacrificing all of its material advantages. The form described is merely explanatory, and it is the intention of the following claims to encompass and include such changes.

While the present disclosure has been described with reference to various embodiments, it will be understood that these embodiments are illustrative and that the scope of the disclosure is not limited to them. Many variations, modifications, additions, and improvements are possible. More generally, embodiments in accordance with the present disclosure have been described in the context of particular implementations. Functionality may be separated or combined in blocks differently in various embodiments of the disclosure or described with different terminology. These and other variations, modifications, additions, and improvements may fall within the scope of the disclosure as defined in the claims that follow.

What is claimed is:

1. A hearing assistive device comprising:

a cochlear implant; and a tactile aid, comprising, at least one microphone;

at least one vibration signal processing mechanism that receives an input audio signal from the at least one microphone and generates an output signal according to the input audio signal; and at least one vibrator configured to be placed adjacent to a pinna of a user outside an ear canal of an ear of the user, the vibrator configured to generate a vibration stimulation signal on a skin of the user according to the output signal, wherein the vibration stimulation signal generates a vibration sensation on the skin of the user, the vibration sensation associated with a predetermined carrier vibration signal amplitude specific for simulating a predetermined low frequency audio signal, and wherein the vibration signal processing mechanism comprises a band-pass filter having an upper cut-off frequency that is essentially lower than an effective frequency range of the cochlear implant such that the predetermined low frequency audio signal simulated by the vibration signal processing mechanism complements a frequency range associated with the cochlear implant, and wherein the at least one microphone operates in combination with the tactile aid by selecting providing spatial hearing cues and directional sensitivity to the user via the vibrator.

2. The hearing assistive device of claim 1, wherein the vibrator comprises at least one of a linear resonant actuator, a moving coil resonator or a piezoelectric/capacitive transducer.

3. The hearing assistive device of claim 1, wherein the vibration signal processing mechanism comprises an envelope extractor configured to extract envelopes from the input audio signal.

4. The hearing assistive device of claim 3, wherein the vibration signal processing mechanism comprises a modulator that is configured to modulate a carrier signal with the extracted envelopes.

5. The hearing assistive device of claim 3, wherein the vibration signal processing mechanism comprises a filter that is configured to perform a Hilbert transformation on the input audio signal.

6. The hearing assistive device of claim 3, wherein the vibration signal processing mechanism comprises a combined rectifier and a low-pass filter to separate the extracted envelopes from a fine structure portion of the input audio signal.

7. The hearing assistive device of claim 1, wherein the microphone comprises a directional microphone with spatial hearing cues passed on to the user.

8. The hearing assistive device of claim 1, further comprising a plurality of microphones having an orientation relative to one another to provide directional sensitivity.

9. The hearing assistive device of claim 1, wherein the cochlear implant generates electrical stimulation within a cochlea of the user using one or more electrodes.

10. A hearing assistive device comprising:

at least one microphone;

at least one audio signal processing mechanism that receives an input audio signal from the microphone and generates a first output signal according to the received input audio signal, the first output signal coupled to a transducer that generates sound in an ear of a user;

at least one vibration signal processing mechanism that receives the input audio signal from the at least one microphone and generates a second output signal according to the input audio signal;

at least one vibrator configured to be placed adjacent a pinna and outside an ear canal of the ear of the user, the vibrator configured to generate a vibration stimulation signal on the skin of the user according to the second output signal; and wherein the vibration stimulation signal generates a vibration sensation on the skin of the user, the vibration sensation associated with a predetermined carrier vibration signal amplitude specific for simulating a predetermined low frequency audio signal, and wherein the vibration signal processing mechanism comprises includes an upper cut-off frequency that is essentially lower than an effective frequency range of a cochlear implant, and wherein the at least one microphone operates in combination with the at least one vibrator by selecting providing spatial hearing cues and directional sensitivity to the user via the at least one vibrator.

11. The hearing assistive device of claim 10, wherein the transducer comprises one or more electrodes that are disposed in a cochlea of the user.

12. The hearing assistive device of claim 10, wherein the vibrator comprises at least one of a linear resonant actuator, a moving coil resonator or a piezoelectric/capacitive transducer.

13. A hearing assistive method comprising:

providing at least one microphone;

receiving, using at least one audio signal processing mechanism, an input audio signal from the microphone and generates a first output signal according to the received input audio signal, the first output signal coupled to a transducer that generates sound in an ear of a user;

receiving, using at least one vibration signal processing mechanism, the input audio signal from the at least one microphone and generates a second output signal according to the input audio signal; and generating, using at least one vibrator configured placed adjacent a pinna and outside an ear canal of the user, a vibration stimulation signal on the skin of the user according to the second output signal, wherein the vibration stimulation signal generates a vibration sensation on the skin of the user, the vibration sensation associated with a predetermined carrier vibration signal amplitude specific for simulating a predetermined low frequency audio signal, and wherein the vibration signal processing mechanism comprises includes an upper cut-off frequency that is essentially lower than an effective frequency range of a cochlear implant, wherein the at least one microphone operates in combination with the at least one vibrator by selecting providing spatial hearing cues and directional sensitivity to the user via the at least one vibrator.

14. The hearing assistive method of claim 13, further comprising extracting envelopes from the input audio signal.

15. The hearing assistive method of claim 13, further comprising modulating a carrier signal with the extracted envelopes.

16. The hearing assistive device of claim 1, wherein the vibration sensation is proportional to the predetermined carrier vibration signal amplitude.

17. The hearing assistive device of claim 1, wherein the predetermined carrier vibration signal amplitude is 350 Hz.

* * * * *